US005898389A

United States Patent [19]

Deese et al.

[11] Patent Number: 5,898,389

[45] Date of Patent: Apr. 27, 1999

[54] BLACKOUT BACKUP FOR TRAFFIC LIGHT

[75] Inventors: Raymond E. Deese, Corona, Calif.; Carl B. Henderson, Sparks, Nev.; Timothy W. Connolly, Vacaville, Calif.

[73] Assignee: Electro-Tech's, Corona, Calif.

[21] Appl. No.: 08/947,560

[22] Filed: Oct. 9, 1997

Related U.S. Application Data

[

[60] Provisional application No. 60/028,318, Oct. 11, 1996.

[51] Int. Cl.[6] ..... G08G 1/095

[52] U.S. Cl. ..... 340/907; 340/912; 340/916; 340/925; 340/931

[58] Field of Search ..... 340/907, 912, 340/925, 916, 931, 641, 642, 660, 661, 662, 663; 362/800

[56] References Cited

U.S. PATENT DOCUMENTS

| | | | |
|---|---|---|---|
| 3,795,905 | 3/1974 | Wright | 340/642 |
| 4,068,216 | 1/1978 | Brouwer et al. | 340/641 |
| 4,954,822 | 9/1990 | Borenstein | 340/925 |
| 5,136,287 | 8/1992 | Borenstein | 340/925 |
| 5,457,450 | 10/1995 | Deese et al. | 340/912 |
| 5,663,719 | 9/1997 | Deese et al. | 340/912 |

*Primary Examiner*—Jeffery A. Hofsass
*Assistant Examiner*—Daryl C. Pope
*Attorney, Agent, or Firm*—Knobbe, Martens, Olson & Bear, LLP

[57] ABSTRACT

A system and method for automatically supplying a flashing line voltage from power stored in an auxiliary battery to power red traffic signal lamps using clusters of light emitting diodes during a blackout condition. A plurality of flash block connectors are pin-to-pin compatible with the flash block jumper blocks of an already installed traffic light control system so that the existing system is retrofitted without any cabinet or field rewiring or any cutting or crimping of the wires.

10 Claims, 4 Drawing Sheets

BLACKOUT BACKUP FOR TRAFFIC LIGHT

Pursuant to 35 U.S.C. § 119(e), this application claims the priority benefit of Provisional application No. 60/028,318 filed Oct. 11, 1996.

FIELD OF THE INVENTION

This invention relates to a system and method for automatically providing a blackout backup system for traffic lights using clusters of light emitting diodes for the red signal lamps.

BACKGROUND OF THE INVENTION

Traffic lights are indispensable, especially at busy intersections. Unfortunately, the effectiveness of a traffic light is limited by its power source. During a blackout, traffic signals lose their utility line AC source of power and go dead. It is at this time, especially at night or when visibility is reduced, that intersections can become extremely perilous. Vehicles coming from other roads or directions are not adequately warned of approaching danger. In fact, many accidents occur every year during just such scenarios.

In the past, battery operated backup systems were not feasible because of the substantial power requirements for the incandescent light bulbs. Thus, a backup battery would quickly lose its charge unless, of course, unrealistically very large, expensive high capacity batteries were used. Furthermore, as traffic lights have flourished, they have become increasingly standardized in their size, control and operation.

SUMMARY OF THE INVENTION

The present invention is a blackout backup system for traffic lights using clusters of light emitting diodes (LEDs) as substitutes for the incandescent lamp used for the red signal lamps. A preferred LED traffic signal light is disclosed and claimed in U.S. Pat. No. 5,457,450. LED signal lights so constructed are easily mounted and connected within existing traffic signals to replace the incandescent bulb of the red signal lamps. Under nonblackout conditions, the traffic signal system performs as it normally performs. The existing traffic signal controller powered by the AC utility line runs the traffic signal lights as programmed.

However, under blackout conditions, when the utility lines are unable to supply a voltage or are only able to supply a voltage below a preset value, a blackout backup system constructed in accordance with the invention automatically supplies emergency battery power to the light emitting diodes (LEDs) which make up the red signal light. Advantageously, this power is supplied as a series of low frequency pulses so that the LEDs, and thus the red traffic lights, flash on and off during the blackout condition. An hour meter on the backup controller tracks and displays the amount of time the backup system has powered the traffic lights in flash mode.

When the blackout condition ends, that is, when the present invention detects that the power line has become fully active or is supplying a voltage above another preset voltage, then the traffic signal system reverts to normal operation using the utility lines. The inverter subsequently ceases to power the backup controller and LEDs, and instead begins to recharge the battery. If during battery operation the battery should drop below a specified value, then the battery disconnects from the inverter and no power is available to operate the traffic lights until the utility power lines are restored. Battery voltage is monitored by the controller and is displayed on the battery voltage meter.

Compatibility with existing traffic signal lights and controlling systems is a very significant feature of the present invention. The existing traffic light control system is typically housed in a large traffic signal control cabinet which uses a series of flash block connectors and flash block jumper blocks programmed to red, yellow or green by jumper wires to energize the approximate traffic lights. The present invention uses flash block connectors which are totally compatible with the existing flash blocks programmed for red lights. Installation of the present invention involves, literally, merely pulling the existing red light flash block connectors from the flash blocks and pushing the flash block connectors of the present invention into the same flash blocks. This retrofit connection has the important advantage of not requiring any cabinet or field rewiring or any cutting and crimping of wires. Under nonblackout conditions, the flash block connectors of the present invention act exactly like the flash block connectors they replaced, i.e., merely as jumper wires between the programmed electrical paths of the flash blocks. However, under blackout conditions the backup controller of the present invention takes over and programs the flash block connectors of the red lights to flash on and off. The present invention is designed to fit easily within existing control cabinets using existing AC outlets now present in the control cabinets.

DETAILED DESCRIPTION OF THE PREFERRED EMBODIMENT

Figures 1, 1A:
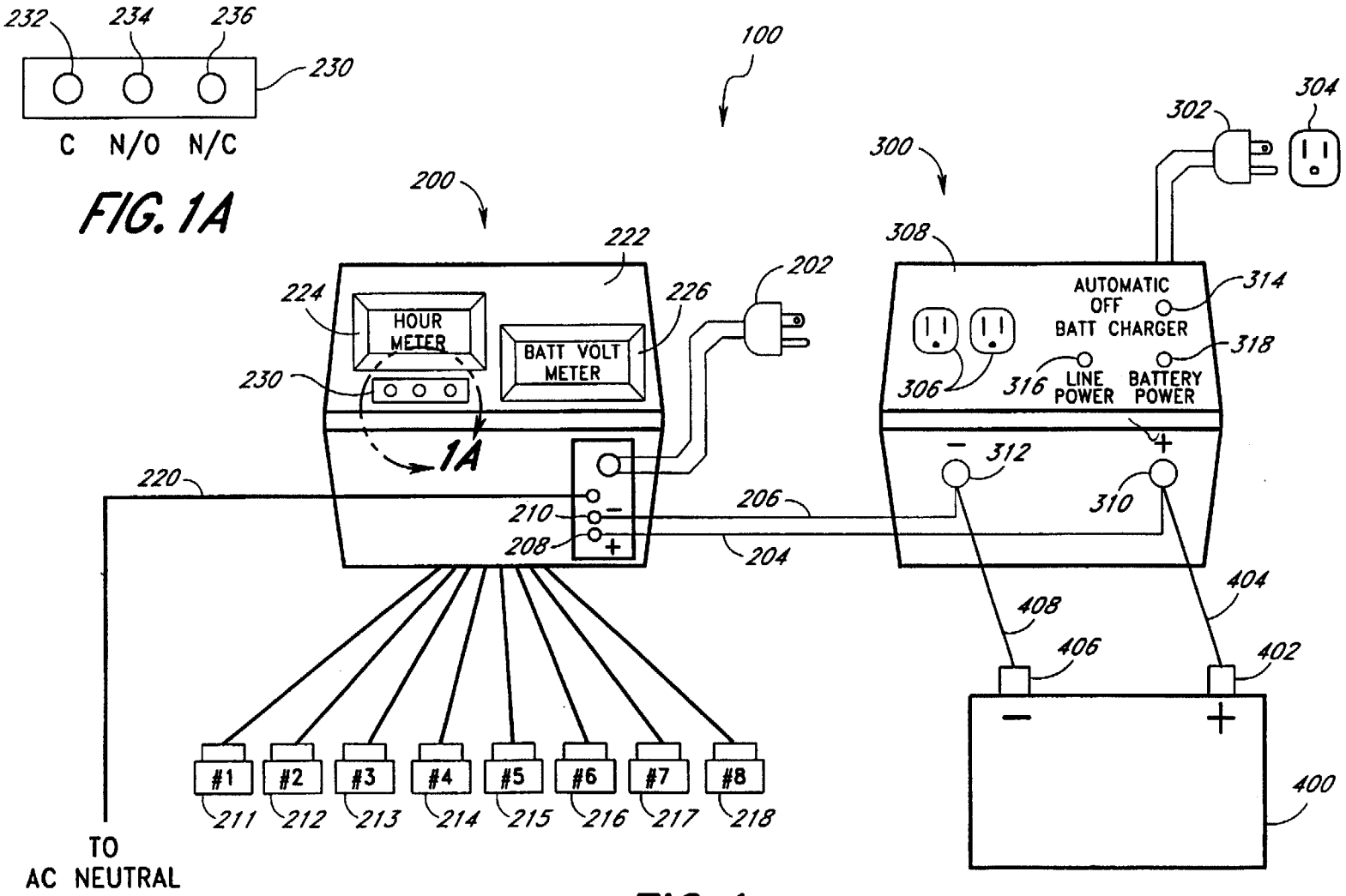
FIG. 1 is a diagram showing the various elements and connections between the various elements of the invention.
FIG. 1A is an inset magnifying the terminal strip.

The preferred embodiment of the present invention is shown generally at 100 in FIG. 1 and indicates a backup controller unit 200, an inverter 300, a battery 400, a series of flash block convertors 211–218, and the inter-connections between the various elements.

The elements shown in FIG. 1 are normally placed within an existing traffic signal control cabinet (not shown). The inverter 300 draws utility power through its AC power cord 302 from an AC outlet 304 inside the traffic signal control cabinet. The backup controller unit 200 has an AC power cord 202 which is inserted into one of the AC outlets 306 on the front panel 308 of the inverter 300. The battery 400 is connected to the inverter 300 by battery cables 404 and 408 from the positive and negative terminals 402 and 406, respectively, of the battery 400 to the inverter's positive and negative DC terminals 310 and 312, respectively. The backup controller 200 has positive and negative DC terminals 208 and 210, respectively, which are connected to the positive and negative DC inverter terminals 310 and 312, respectively, by cables 204 and 206.

Battery 400 is advantageously a gel cell, deep cycle battery. Such batteries are commonly available from several manufacturers. A fully charged battery should normally have between 12.7 to 13 V across its terminals. To prevent connecting the battery backwards, it is advantageous to have the positive terminal larger than the negative terminal. Typically, battery cable 404 is a red, 8 gage cable connecting the positive battery terminal 402 to the positive inverter terminal 310. This red, 8 gage cable has a smaller terminal, 5/16 inch, on one end which is connected to the positive inverter terminal 310 and has a larger terminal, 3/8 inch, at the other end which is connected to the positive battery terminal 402. Similarly, typically, a black, 8 gage battery cable 408 connects the negative battery terminal 406 to the negative inverter terminal 312.

A preferred embodiment for the inverter 300 is made by Tripp Lite of Chicago, Ill., and is generally equivalent to their Model APS 750 called the CORONA. As described above, the inverter's power cord 302 is plugged into the AC outlet 304 provided within the existing traffic signal control cabinet. Inverter 300 has a front panel 308 having two AC outlets 306, a three function control switch 314, a line power indicator 316, and a battery power indicator 318. The inverter 300 also has a positive DC terminal 310 and a negative DC terminal 312 to which the battery 400 and backup controller 200 are connected.

The function of inverter 300 is to monitor the AC utility line coming from the AC outlet 304 and supply auxiliary AC and DC power to the controller 200 from battery 400 during blackout conditions. A blackout condition begins when the AC utility line, which typically provides 120 VAC, drops below a preset value (typically 95 VAC). Under blackout conditions the battery 400 will then power the inverter 300, which converts 12 VDC to 120 VAC, at the AC outlets 306 on the face 308 of the inverter 300, which, in turn, supply 120 VAC to the backup controller 200. As long as the inverter 300 is running on battery power the battery power indicator light 318 will illuminate red. A blackout condition ends when the AC utility line provides a voltage above a preset value, in this embodiment 99 VAC, for at least a preset time, in this embodiment five seconds. The preset delay of five seconds avoids recognizing spikes or temporary restorations of power to the AC utility line. After a blackout condition ends, the inverter 300 automatically disconnects power to the AC outlets 306, and instead will begin to recharge the battery 400. Once the normal line voltage is restored, the traffic signal lamps will receive power from the line AC source and function in their usual manner. The line power indicator 316 will illuminate green as long as normal AC line power is present at outlet 304.

The inverter 300 has a three function control switch 314 on the front panel 318. If the control switch 314 is in the up position, the first of its three positions, the inverter 300 is in the automatic mode. In the "automatic" mode, the inverter 300 monitors the utility line power from the AC outlet 304 provided within the control cabinet, recharges the battery 400, and supplies no power to its AC outlets 306. When a blackout condition occurs, the battery 400 will automatically power the inverter 300, and the AC outlets 306 will supply auxiliary AC power, as described above. The inverter 300 will typically be left in this "automatic" mode. If the control switch 314 is changed in the center position, to the second of its three positions, then it is in the "off" mode. The "off" mode turns both the inverter 300 off and thus the battery 400 is not recharged and the AC outlets 306 are not supplied power. If the control switch 314 is changed to its down position, the third of its three positions, then the inverter 300 is in the "battery recharge" mode. In both the "off" mode and the "battery recharge" mode, the battery 400 will not power the AC outlets 306 during a blackout condition.

The backup controller 200 is connected to the inverter 300 by a power cord 202 plugged into an AC outlet 306 on the front panel 308. The AC neutral wire 220 of the backup controller 200 is connected to the control cabinet's AC neutral power strip. This power cord 202 becomes live under a blackout condition when the battery 400 is powering the inverter 300. Furthermore, the backup controller 200 has a positive DC terminal 208 and a negative DC terminal 210. These terminals are connected to the inverter DC terminals 310 and 312 of the same polarity which are connected to the battery terminals 402 and 406 also of the same polarity. In this embodiment, the positive backup controller DC terminal 208 is connected to the positive inverter DC terminal 310 by a red, 18 gage wire. The negative backup controller DC terminal 210 is connected to the negative inverter DC terminal 312 by a black, 18 gage wire.

The front panel 222 of the backup controller 200 includes a terminal strip 230, a battery voltage meter 226, and an hour meter 224. The battery voltage meter 226 is a DC volt meter which indicates the battery voltage. The hour meter 224 indicates the amount of time the backup system was operating the traffic lights in flash mode.

The invention further provides for energization of an external alarm when the blackout condition occurs. The terminal strip 230, enlarged in FIG. 1A, connects to a set of relay contacts: a common contact 232, a normally open contact 234, and a normally closed contact 236. See FIG. 3 for details of this relay. During nonblackout conditions when the backup controller 200 receives no AC power from the inverter AC outlets 306, the common contact 232 and the normally open contact 234 form an open circuit, and the common contact 232 and the normally closed contact 236 form a short circuit. During blackout conditions when the backup controller 200 receives AC power from the inverter AC outlets 306, this relay is energized such that the common contact 232 and the normally open contact 234 form a short circuit, and the common contact 232 and the normally closed contact 236 form an open circuit. Thus, if desired, meters or other more sophisticated monitoring equipment can be externally attached to give warning, such as by telephone or data line, when a blackout condition occurs.

In existing traffic control systems, it is the flash block jumper blocks that determine how a traffic signal system is programmed. Referring FIGS. 2A and 2B, flash block jumper block 400 has fifteen prongs and fifteen female electric contacts. The jumper blocks 400 are shown larger than the actual blocks in use which measure approximately 1½" long, 11/16" wide, and 15/16" high. By placing jumper wires in certain patterns in the female contacts of the flash block jumper block 400, the programming of a given color light in a given traffic signal is achieved. As described below, a particular pattern of three jumper wires between six of the holes in a given flash block jumper block will cause the traffic light to turn red when the given flash block is powered. Other patterns of jumper wires will cause the traffic light to turn green or yellow. The required jumper wire patterns for a given result are standardized throughout the nation and are well known in the art.

Compatibility is very important for any improvement in the traffic light art. As described in U.S. Pat. No. 5,457,450, LEDs can be clustered in two dimensional arrays such as in the shape of filled-in circles or arrows, or even in three dimensional arrays in the shape of incandescent light bulbs. The retrofitting of the LED arrays means that arrays can be screwed into sockets where incandescent light bulbs have been removed. LEDs are far superior to incandescent light bulbs because of their durability and reliability, but especially because of their energy efficiency.

Another aspect of compatibility is size. Any improvement in the art, must be able to fit inside the standard traffic system controller cabinet. The backup controller 200, the modified inverter 300, and the battery 400 of the present invention fit easily inside existing traffic control cabinets. The preferred embodiment places the present invention on a mounting rack within the controller cabinet.

A significant feature of the invention is that it is very simply and conveniently connected into an existing standard traffic system controller by pre-programmed flash block connectors 211 to 218. Installation of this invention requires merely pulling the existing system's flash block jumper blocks 400 and pushing the backup controller's flash block connectors 211 to 218 in their places. Such a retrofit connection has the very important advantage of not requiring any controller cabinet or field rewiring or any cutting and crimping of wires. The embodiment of the present invention shown in FIGS. 1 and 3 uses eight flash block connectors 211 to 218 to control a four-way intersection in which each traffic signal has a red light and a red arrow. Although there are eight flash block connectors 211 to 218, they need not all be used. For example, if the four-way intersection does not have red arrows, then only four of the flash block connectors will be needed. Under nonblackout conditions, the backup controller 200 is not powered, and the flash block connectors 211 to 218 of the present invention act exactly like the flash block jumper blocks they replaced; that is, they act like passive jumper wires closing chosen electrical paths in the flash block circuitry to effect the programming of the red traffic lights. During blackout conditions, when the backup controller 200 is completely powered, the backup controller 200 not only programs the eight flash block connectors 211 to 218, but also powers the red LED arrays to flash on and off at a preset rate.

Figure 2A:
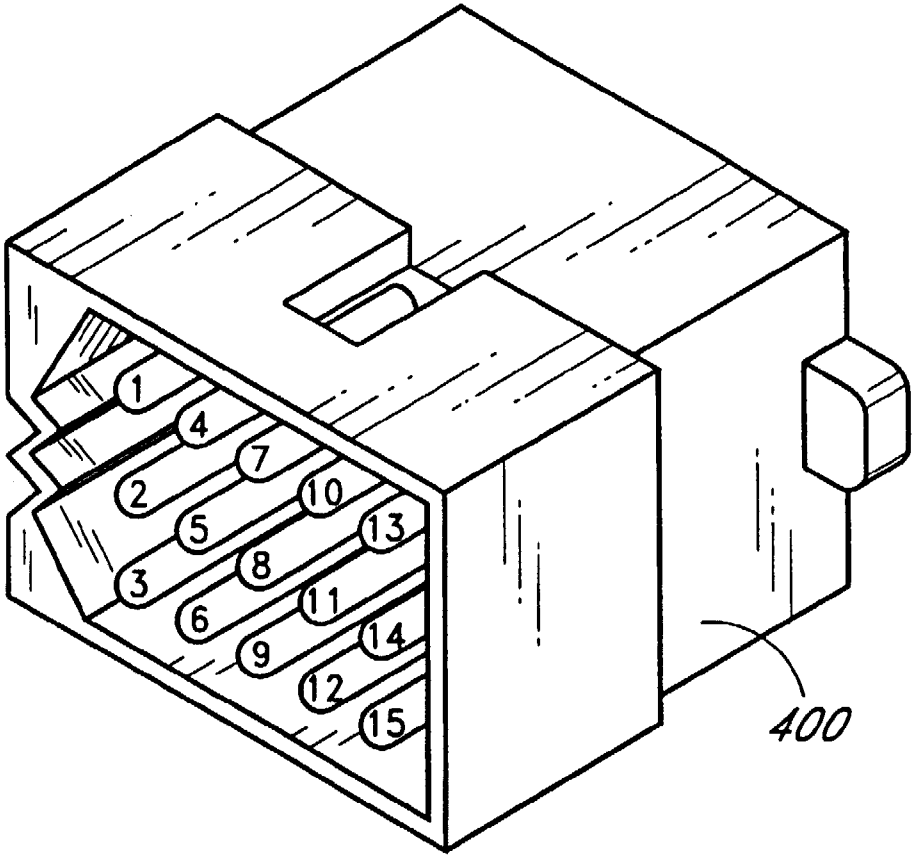
FIG. 2A is a perspective view of a standard flash block jumper block showing the male end of the jumper block.
Figure 2C:
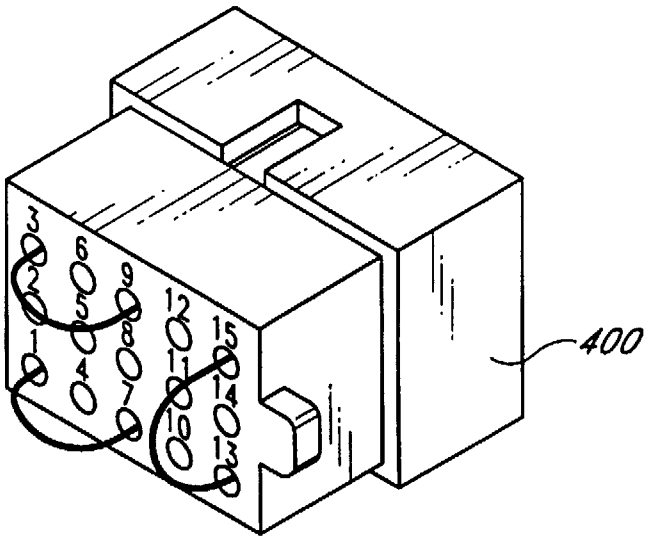
FIG. 2C is a perspective view of a standard flash block jumper programmed for yellow with three jumper wires.
Figure 2B:
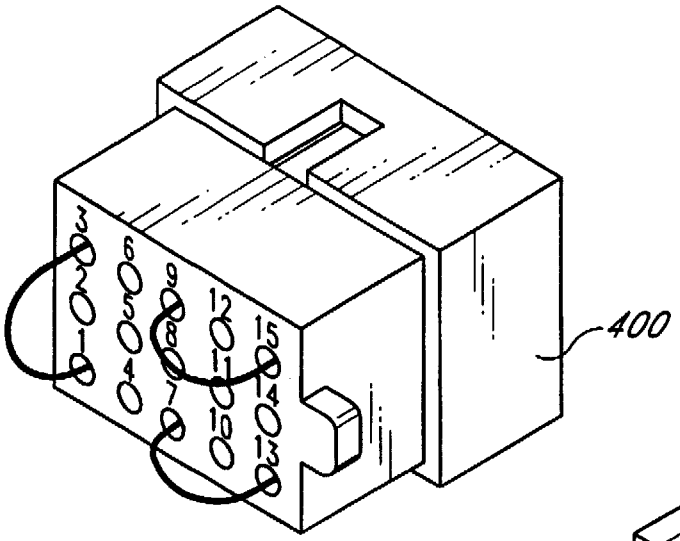
FIG. 2B is a perspective view of a standard flash block showing the female end of the jumper block programmed for red with three jumper wires.

As mentioned above, simply by placing jumper wires in certain patterns in a flash block connector, the programming of a given light in a given traffic signal is achieved as illustrated in FIG. 2B and FIG. 2C. For example, placing jumper wires between pins 1 and 3, 7 and 13, and 9 and 15 of a flash block jumper block 400, as shown in FIG. 2B, will cause the traffic light to turn red when the given flash block is powered. By way of comparison, FIG. 2C shows the jumper wire pattern for a yellow light. The required jumper wire patterns for a given result are standardized throughout the nation and are well known in the art.

Figure 2D:
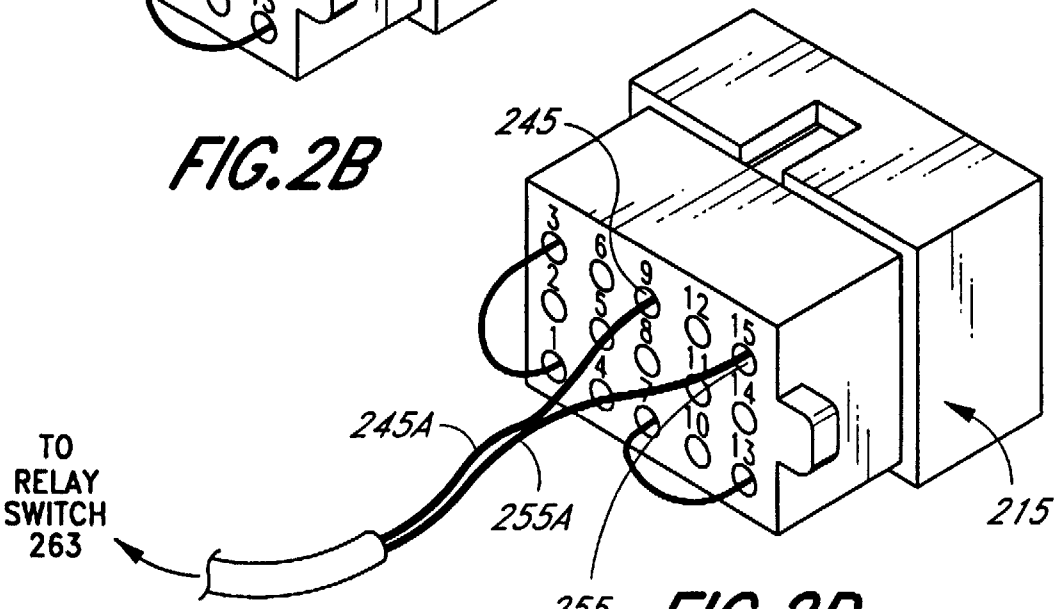
FIG. 2D is a perspective view of one of the backup flash block connectors constructed in accordance with this invention.

FIG. 2D shows a schematic of the programming of one of the backup controller's flash block connectors, specifically backup controller flash block connector #5 215. Backup controller flash block connector #5 215 is also pictured in FIG. 1. While FIG. 2A, 2B, and 2C show flash block connectors as found in existing traffic signal systems, FIG. 2D shows the present invention's flash block connectors. Note that the following description of the flash block connector #5 215 is applicable to the other flash block connectors 211–214 and 216–218 of FIG. 1. As in existing flash block jumper blocks, the backup controller connector #5 215 has female contacts 1 and 3, as well as contacts 7 and 13, connected with respective jumper wires. However, where the backup controller flash block connector differs from existing flash block connectors is that instead of placing a jumper wire between 9 and 15 (as the flash block connector is ordinarily programmed for red as shown in FIG. 2B), wire 245A extends from pin 9 and wire 255A extends from pin 15 of backup controller flash block connector #5 215. These two wires are connected to the make and break contacts of relay switch 263 shown in FIG. 3. Switch 263 is triggered by the relay 288 which is energized by the AC voltage 260 from the inverter during a blackout condition. If the relay 288 is not energized, as in a nonblackout condition, relay switch 263 is in the state shown in FIG. 3, and pin #9 (245) remains connected to pin #15 (255) of backup controller flash block connector #5 215. The relay switch 263 then acts like a jumper wire. Therefore, in a nonblackout condition, the backup controller flash block connector #5 215 acts just like the flash block jumper block it replaced. However, when the relay 288 is energized, as in a blackout condition, the relay 288 pulls down the switch 263 connecting pin 255 directly to one of the signal and power outputs 295 of the backup controller power and signal circuitry. Pin 255 then receives AC voltage, alternating on and off, causing the red light or arrow connected to flash block connector 215 to flash on and off.

Figure 3:
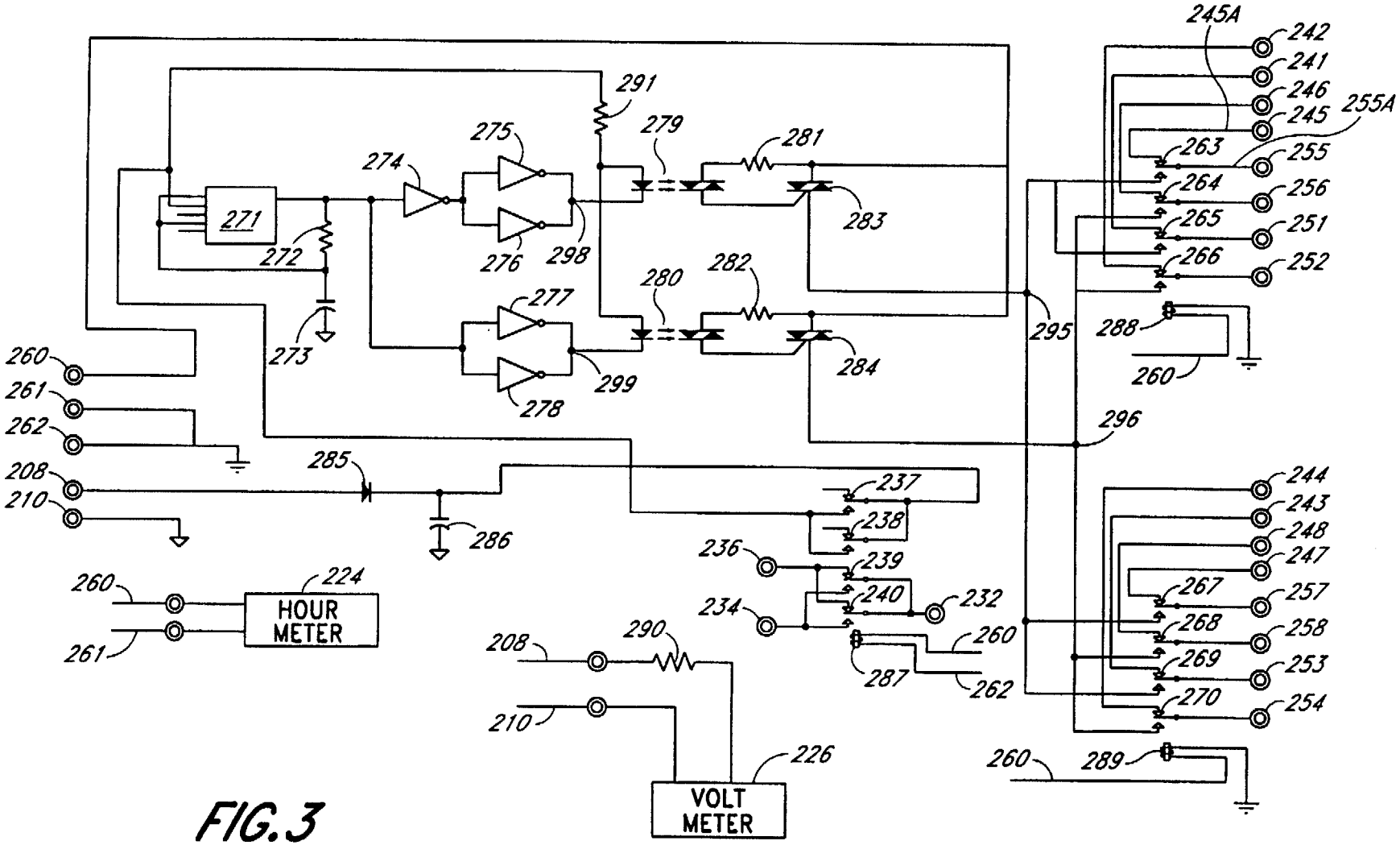
FIG. 3 is a schematic diagram showing the backup controller circuitry.

The eight backup controller flash block connectors pins 241 to 248 and the eight backup controller flash block connectors pin pins 251 to 258 of each of the backup controller flash block connectors 211 to 218 are shown in FIG. 3 and operate in the same manner as described for flash block connector 215.

FIG. 3 is a detailed schematic diagram showing the backup controller circuitry. As mentioned above, to program a flash block connector for a red light, jumpers must be placed between pins 1 and 3, 7 and 13, and 9 and 15. As shown in FIG. 2D, the flash block connectors of the present invention have jumpers in place for pins 1 and 3 and 7 and 13. However, instead of having jumpers between 9 and 15, each flash block connector of the present invention has a separate wire leading from 9 and a separate wire leading from 15. In each of the eight flash block connectors, each pair of wires are hooked up to switches 263 to 270 which are triggered when the relays 288 and 289 are energized. The relays 288 and 289 are energized when the AC outlets on the inverter supply an AC voltage 260.

Thus the switches present two scenarios. Under nonblackout conditions, the inverter does not power the AC outlets on its front panel and thus the supplied AC voltage 260 is 0 VAC. Thus the relays 288 and 289 are not energized and the switches remain as shown in FIG. 3. Pin 9 242 of flash block connector #2 212 is connected to pin 15 252 of the same flash block connector #2 212. Pin 9 241 and pin 15 251 of flash block connector #1 211 are connected. Pin 9 246 and pin 15 256 of flash block connector #6 216 are connected. Pin 9 245 and pin 15 255 of flash block connector #5 215 are connected. Pin 9 244 and pin 15 254 of flash block connector #4 214 are connected. Pin 9 243 and pin 15 253 of flash block connector #3 213 are connected. Pin 9 248 and pin 15 258 of flash block connector #8 218 are connected. Pin 9 247 and pin 15 257 of flash block connector #7 217 are connected. In sum, the switches 263 to 270 connect pins 9 and 15 on every flash block connector. In other words, the relay switches 263 to 270 act like jumper wires. And since the present invention's flash block connectors, in this embodiment, already have jumper wires between pins 1 and 9 and 7 and 13, during nonblackout conditions the present invention acts just like the flash block connectors that they replaced. Therefore, during nonblackout conditions, the existing traffic control system is able to function as if the original flash block connectors were installed.

The situation is quite different during blackout conditions. During blackout conditions, the AC outlets on the front panel of the inverter become active and supply an auxiliary AC voltage on lead 260 which energizes the relays 288 and 289 and pulls down the switches 263 to 270. Now the auxiliary AC voltage outputs 295 and 296 of the backup controller circuitry control the programming and powering of the red lights and arrows. Output 295 is connected to pin 15 255, 251, 257, and 253 in half of the flash block connectors. Output 296 is connected to pin 15 256, 252, 258, and 254 in the other flash block connectors. As will be explained below, output 295 and output 296 alternate in supplying the AC voltage 260 from the AC outlets on the front panel of the inverter. When an output line 295 or 296 supplies AC voltage 260 to a flash block connector's pin 15, the red light or arrow will turn on. When an output line 295 or 296 does not supply AC voltage 260 to a flash block connector's pin 15, the red light or arrow will turn off. Furthermore, outputs 295 and 296 alternate in drawing AC voltage on 260 supplied to them and each of these outputs 295 and 296 receive inverter AC voltage 260 for a preset duration. The result is that at a four-way intersection, half the red lights and arrows are on when the other red lights and arrows are off, and visa versa, to reduce the current drain from the battery.

The backup controller circuitry controls which output 295 or 296 is on and for how long. As noted above, the AC outlet on the front panel of the inverter supplies an AC voltage 260 during blackout conditions. The AC neutral of the cabinet 261 is connected to the AC neutral 262 of the backup controller and inverter. The battery voltage at 208 goes through a biasing diode 285 and a high frequency filter 286, a 220 μF capacitor in this embodiment, to a relay switch 237 which is governed by a relay 287 in the terminal strip. The relay 287 can only be energized when the AC outlet on the front panel of the inverter is powered providing AC voltage 260. When the relay 287 is not energized, the switches 237 to 240 remain as depicted in the diagram. On the terminal strip, the normally closed contact 236 and the common contact 232 form a short circuit while the normally open contact 234 and the common contact 232 form an open circuit. Furthermore, the battery voltage 208 is applied to an open circuit. As such, the backup controller circuitry does not receive any battery power.

However, under blackout conditions when the AC voltage 260 turns on, the relay 287 energizes pulling down the switches 237 to 240. As a result, the normally open contact 234 and the common contact form a short circuit while the normally closed contact 236 and the common contact 232 form an open circuit. Furthermore, the battery voltage 208 now reaches the backup controller circuitry.

As discussed above, the battery current is reduced by having alternate sets of traffic lights turn on and off so that all of the red lights are not on simultaneously.

The circuit that accomplishes this function includes a general purpose timer chip 271 connected to battery voltage 208. For this specific embodiment, the TLC555C is used for chip 271. The output of the general purpose timer chip 271, running in monostable operation, is a square wave. The frequency of the square wave is a function of the product of the resistor 272 and the capacitor 273 and is set at the desired flashing frequency. In this specific embodiment, the resistor is 273 kΩ and the capacitor 273 is 3.3 μF.

The next stage of the circuitry is the inverter stage. The specific embodiment uses the MOTOROLA MC14049UB. The square wave output is split and inverted once through one set of inverters 277 and 278 and is inverted twice through two sets of inverters 274 to 276. Thus the output of the two sets of inverters 298 is the same square wave while the output of the single set of inverters 299 is the inversion of the square wave. In other words, the two outputs 298 and 299 are out of phase by 180 degrees. Two inverters in parallel 275 and 276 or 277 and 278 supply sufficient current to the respective outputs 298 and 299.

The next stage of the circuitry isolates the battery driven circuitry from the AC driven circuitry by using an optoisolator 279 and 280 called a triac driver. The specific embodiment uses a MOTOROLA MOC3062. As the high voltage phase of the square wave reaches one of the optoisolator 279 or 280, the low voltage phase of the square wave reaches the other optoisolator 280 or 279. A resistor 291, 680 Ω in this specific embodiment, limits current flow. The battery voltage 208 and the low voltage phase of the square wave create a sufficient voltage across the diode in the optoisolator 279 or 280 (which use the potential energy to create photons received by the photodetector of the optoisolator 279 or 280) to create a current that passes through a resistor 281 or 282 and create a voltage drop across a triac type thyristor 283 and 284. This specific embodiment uses a MOTOROLA MAC320A 10 as its triac type thyristor 283 and 284. With the application of voltage drop, the triac type thyristor 283 and 284 switches from a blocking to a conducting state for either polarity of applied anode voltage. As such, the auxiliary AC voltage 260 from the inverter 300 is able to pass through one or the other of the triac type thyristors 283 or 284 and power a set of red lights or arrows through pin 15 of four of the flash block connectors 255, 251, 257, and 253 or 256, 252, 258, and 254.

On the other hand, the battery voltage 208 and the high voltage phase of the square wave 298 or 299 do not create a sufficient voltage drop across the diode in the optoisolator 279 or 280 to generate insufficient photons to create any current in the photodetector of the optoisolator 279 or 280. Without enough current from the photodetector, there is insufficient voltage drop across the resistor 281 or 282, and thus, the triac type thyristors 283 or 284 remain in a blocking state. Thus, at any given time, the AC voltage 260 cannot get through the triac type thyristors 283 or 284, and, thus, at any given time, one of the outputs 295 or 296 will not light red lights or arrows connected to it.

So, while the optoisolators 279 and 280 isolate the battery driven circuit from the AC voltage circuit, the battery driven circuit signal succeeds in modulating the AC voltage 260. Therefore, during blackout conditions, at any one time, four of the flash block connectors 215, 211, 217, and 213 or 216, 212, 218, and 214 are receiving AC voltage, and thus, at any one time, four of the red traffic are on. At the same instant, four of the flash block connectors 216, 212, 218, and 214 or 215, 211, 217, and 213 are not receiving AC voltage, and thus, at any one time, four of the red traffic lights are off. Which set of red lights is on and which set of red lights is off is totally dependent upon which phase of the battery driven square wave reaches the optoisolator circuit 279 or 280.

Because the square wave circuitry and the inverter are battery dependent, there is a minimum battery voltage below which the present invention will not function properly. Therefore, to protect against malfunction a preset value is advantageously set at which the battery disconnects from the inverter. For this specific embodiment, when the battery voltage 208 drops below 9.6 V, the battery will disconnect from the inverter 300, and no power will be available to operate the traffic lights until the AC line power returns.

Since this is the worst of all possibilities, ways in which to conserve battery power may be advisable in geographic areas prone to extended blackout conditions. Reducing the percentage of a given cycle in which the lights are on or decreasing the number of active LEDs in an array per cycle, for example, will reduce energy consumption. Although this will make the lights appear dimmer, it is, of course, preferable to no flashing light at all.

The backup controller also features two meters. The first is the hour meter 224. The hour meter 224 measures the length of time in which the backup controller has been running the traffic lights in flash mode. The second is the voltage meter 226 which is connected through a current limiting resistor 290, which for this specific embodiment is 60.4 kΩ, to the backup controller's DC terminals 208 and 210.

Although the present invention has been described with reference to specific embodiments, it is to be understood that the scope of this invention is not limited by these embodiments. Numerous modifications may be made to these embodiments, and the other arrangements may be devised by those skilled in the art without departing from the spirit and scope of the invention.

What is claimed is:

1. A retrofit blackout backup system for red traffic signal lights using clusters of light emitting diodes that (i) is compatible with the already installed flash block connectors of a traffic light control system, (ii) does not require any cabinet or field rewiring or any cutting or crimping of wires, and (iii) reduces the current required during a blackout condition, comprising:

a plurality of flash block connectors, each of said connectors being pin-to-pin compatible with the flash block jumper blocks of said traffic light control system, said connectors retaining the same jumper wire configuration for the green and yellow traffic lights but with an external connector to the red light traffic pins;

a storage battery;

an inverter coupled to said storage battery for (i) charging said battery from the AC power line during non-blackout conditions and (ii) generating alternating line voltage from the battery during blackout conditions;

a power switch coupled to said inverter;

a driver coupled to said power switch for continuously causing said power switch to open and close during a blackout condition; and a first plurality of relay switches respectively connected to said external connector of each of substantially one-half of said flash block connectors and a second plurality of relay switches respectively connected to said external connector of each of the substantially one-half remaining flush block connectors, said relay switches energized by the AC utility line to maintain said jumper wire configuration for the red traffic lights during a non-blackout condition but disconnecting said red traffic light jumper wire configuration and connecting said red traffic light pins to the output of said power switch during a blackout condition, so that the red traffic lights are flashed on and off during a blackout condition from power stored in said storage battery and so that only substantially one-half of said red traffic lights are on at any one time.

2. A retrofit blackout backup system that is compatible with the already installed flash block connectors of a traffic light control system and does not require any cabinet or field rewiring or any cutting or crimping of wires comprising:

a plurality of flash block connectors, each of said connectors being pin-to-pin compatible with the flash block jumper blocks of said traffic light control system, said connectors retaining the same jumper wire configuration for the green and yellow traffic lights but with an external connector to the red light traffic pins;

a storage battery;

an inverter coupled to said storage battery for (i) charging said battery from the AC power line during non-blackout conditions and (ii) generating alternating line voltage from the battery during blackout conditions;

a power switch coupled to said inverter;

a driver energized by said storage battery for providing a substantially square wave output whose frequency determines the flashing frequency during a blackout condition;

an isolator stage coupling said driver to said power switch for isolating the battery driver circuitry from line voltage so that said power switch is opened and closed during a blackout condition at the desired flashing frequency; and a plurality of relay switches respectively connected to said external connector of each of said flash block connectors, said relay switches energized by the AC utility line to maintain said jumper wire configuration for the red traffic lights during a non-blackout condition but disconnecting said red traffic light jumper wire configuration and connecting said red traffic light pins to the output of said power switch during a blackout condition, so that the red traffic lights are flashed on and off during a blackout condition from power stored in said storage battery.

3. A retrofit blackout backup system that is compatible with the already installed flash block connectors of a traffic light control system and does not require any cabinet or field rewiring or any cutting or crimping of wires comprising:

a plurality of flash block connectors, each of said connectors being pin-to-pin compatible with the flash block jumper blocks of said traffic light control system, said connectors retaining the same jumper wire configuration for the green and yellow traffic lights but with an external connector to the red light traffic pins;

a storage battery;

an inverter coupled to said storage battery for (i) charging said battery from the AC power line during non-blackout conditions and (ii) generating alternating line voltage from the battery during blackout conditions;

a power switch coupled to said inverter;

a driver coupled to said power switch for continuously causing said power switch to open and close during a blackout condition; and a plurality of relay switches respectively connected to said external connector of each of said flash block connectors, said relay switches energized by the AC utility line to maintain said jumper wire configuration for the red traffic lights during a non-blackout condition but disconnecting said red traffic light jumper wire configuration and connecting said red traffic light pins to the output of said power switch during a blackout condition, so that the red traffic lights are flashed on and off during a blackout condition from power stored in said storage battery.

4. The retrofit blackout backup system of claim 3 having an hour meter coupled to the alternating line voltage generated by said inverter to measure the time during which said backup system has been operating said red traffic lights.

5. The retrofit blackout background system of claim 3, wherein said power switch includes a thyristor.

6. A retrofit blackout backup system that is compatible with the already installed flash block connectors of a traffic light control system and does not require any cabinet or field rewiring or any cutting or crimping of wires comprising:

a plurality of flash block connectors, each of said connectors being pin-to-pin compatible with the flash block jumper blocks of said traffic light control system, said connectors retaining the same jumper wire configuration for the green and yellow traffic lights but with an external connector to the red light traffic pins;

a storage battery;

an inverter coupled to said storage battery for (i) charging said battery from the AC power line during non-blackout conditions and (ii) generating alternating line voltage from the battery during blackout conditions;

a power switch coupled to said inverter;

a driver coupled to said power switch for continuously causing said power switch to open and close during a blackout condition; and a plurality of switches respectively connected to said external connector of each of said flash block connectors, said switches energized by the AC utility line to maintain said jumper wire configuration for the red traffic lights during a non-blackout condition but disconnecting said red traffic light jumper wire configuration and connecting said red traffic light pins to the output of said power switch during a blackout condition, so that the red traffic lights are flashed on and off during a blackout condition from power stored in said storage battery.

7. A retrofit blackout backup system that is compatible with the already installed flash block connectors of a traffic light control system and does not require any cabinet or field rewiring or any cutting or crimping of wires comprising:

a plurality of flash block connectors, each of said connectors being pin-to-pin compatible with the flash block jumper blocks of said traffic light control system, said connectors retaining the same jumper wire configuration for the green and yellow traffic lights but with an external connector to the red light traffic pins;

a storage battery;

an inverter coupled to said storage battery for (i) charging said battery from the AC power line during non-blackout conditions and (ii) generating alternating line voltage from the battery during blackout conditions;

a power switch coupled to said inverter;

a driver coupled to said power switch for continuously causing said power switch to open and close during a blackout condition; and means connected to said external connector of each of said flash block connectors for maintaining said jumper wire configuration for the red traffic lights when the AC power line is energized during non-blackout conditions but disconnecting said red traffic light jumper wire configuration and connecting the red traffic pins of said flash jumper blocks to the output of said power switch during a blackout condition, so that the red traffic lights are flashed on and off during a blackout condition using the electrical power stored in said storage battery.

8. A retrofit blackout backup system for traffic light control systems in which the red traffic signal lights use clusters of light emitting diodes comprising:

line voltage responsive means for detecting the occurrence of a blackout condition;

disconnect means coupled to said line voltage responsive means for automatically disconnecting the red traffic light connections in said traffic control system during a blackout condition;

a storage battery;

an inverter coupled to said storage battery for (i) charging said battery from the AC power line during non-blackout conditions and (ii) generating alternating line voltage from the battery during blackout conditions;

a power switch coupled to said inverter;

a driver coupled to said power switch for continuously causing said power switch to open and close during a blackout condition; and means for coupling said disconnect means to the output of said power switch during a blackout condition, so that the red traffic lights are flashed on and off during a blackout condition from power stored in said storage battery.

9. A retrofit blackout backup system for traffic light control systems comprising:

disconnect means for disconnecting the red traffic light connections in said traffic light control system;

a storage battery;

an inverter coupled to said storage battery for (i) charging said battery from the AC power line during non-blackout conditions and (ii) generating alternating line voltage from the battery during blackout conditions;

a power switch coupled to said inverter;

a driver coupled to said power switch for continuously causing said power switch to open and close during a blackout condition; and means for coupling said disconnect means to the output of said power switch during a blackout condition, so that the red traffic lights are flashed on and off during a blackout condition from power stored in said storage battery.

10. The method of supplying backup current to red traffic signal lights comprised of clusters of light emitting diodes during a blackout condition comprising:

pulling the existing red light flash block connectors from the flash blocks of a traffic control system;

inserting in place of said connector retrofitted flash block connectors having an external connection to the red traffic light connectors;

maintaining the electrical current to said red traffic light connectors from the AC power line during non-blackout conditions;

automatically disconnecting said red traffic light connectors from the AC power line and connecting said red traffic light connectors to an auxiliary battery source during a blackout condition.

* * * * *